US007481009B2

(12) United States Patent
De Paoli

(10) Patent No.: US 7,481,009 B2
(45) **Date of Patent: *Jan. 27, 2009**

(54) MAGNETICALLY OPERABLE STUDS FOR FOOTWEAR

(75) Inventor: Thomas De Paoli, Caerano di San Marco (IT)

(73) Assignee: adidas International Marketing B.V., Amsterdam (NL)

( * ) Notice: Subject to any disclaimer, the term of this patent is extended or adjusted under 35 U.S.C. 154(b) by 617 days.

This patent is subject to a terminal disclaimer.

(21) Appl. No.: 11/192,933

(22) Filed: Jul. 29, 2005

(65) Prior Publication Data

US 2005/0257403 A1 Nov. 24, 2005

Related U.S. Application Data

(63) Continuation of application No. 10/654,277, filed on Sep. 3, 2003, now Pat. No. 6,957,503.

(30) Foreign Application Priority Data

Sep. 5, 2002 (DE) ..... 102 41 153

(51) Int. Cl.
*A43B 5/00* (2006.01)

(52) U.S. Cl. ..... 36/134; 36/15

(58) Field of Classification Search ..... 36/134, 36/67 R, 67 D, 15

See application file for complete search history.

(56) References Cited

U.S. PATENT DOCUMENTS

| | | | |
|---|---|---|---|
| 1,141,889 | A | 6/1915 | Trolle |
| D74,252 | S | 1/1928 | Blair |
| 1,847,217 | A | 3/1932 | Klein |
| 1,918,279 | A | 7/1933 | Masterson |
| 1,989,475 | A | 1/1935 | Ehrmann |
| 2,319,292 | A | 5/1943 | Boggs |
| 2,394,454 | A | 2/1946 | Kappeler |
| 2,607,134 | A | 8/1952 | Langer |
| 2,627,097 | A | 2/1953 | Ellis |
| 2,862,312 | A | 12/1958 | Melchiona |
| 3,054,197 | A | 9/1962 | Morgan et al. |
| 3,082,549 | A | 3/1963 | Dolceamore |
| 3,111,735 | A | 11/1963 | Ellis |
| 3,127,687 | A | 4/1964 | Hollister et al. |
| 3,254,440 | A | 6/1966 | Duggar |

(Continued)

FOREIGN PATENT DOCUMENTS

| | | |
|---|---|---|
| DE | 1 760 095 | 4/1968 |

(Continued)

*Primary Examiner*—Marie Patterson
(74) *Attorney, Agent, or Firm*—Goodwin Procter LLP

(57) ABSTRACT

The invention relates to a releasable stud for a shoe sole. The releasable stud includes a stud body and a first fastening mechanism coupled to the stud body. The first fastening mechanism is magnetically operable and interacts with a second fastening mechanism of the shoe sole. In another aspect, the invention relates to a shoe sole for an article of footwear, in particular a sole for a soccer shoe. The shoe sole includes at least one such stud and at least one receptacle, which itself includes the second fastening mechanism, for the stud. At least one of the first fastening mechanism and the second fastening mechanism is magnetically operable to releasably fasten the stud to the receptacle.

13 Claims, 7 Drawing Sheets

U.S. PATENT DOCUMENTS

| | | | | |
|---|---|---|---|---|
| 3,352,034 | A | | 11/1967 | Braun |
| 3,526,976 | A | | 9/1970 | Jacobs |
| 3,626,611 | A | | 12/1971 | Bernier et al. |
| 3,656,245 | A | | 4/1972 | Wilson |
| 3,747,237 | A | | 7/1973 | Wilowski |
| 3,816,945 | A | | 6/1974 | Egtvedt |
| D238,524 | S | | 1/1976 | Senter |
| 3,947,930 | A | | 4/1976 | Martens et al. |
| 3,964,180 | A | | 6/1976 | Cortese |
| 3,977,095 | A | | 8/1976 | Phillips |
| 4,035,934 | A | | 7/1977 | Hrivnak |
| 4,184,272 | A | | 1/1980 | Riggs |
| 4,197,618 | A | | 4/1980 | Bourguignon |
| 4,212,120 | A | | 7/1980 | Bowerman et al. |
| 4,347,674 | A | | 9/1982 | George |
| 4,357,763 | A | | 11/1982 | Fleischmann et al. |
| 4,375,728 | A | | 3/1983 | Dassler |
| 4,399,595 | A | | 8/1983 | Yoon et al. |
| 4,414,763 | A | | 11/1983 | Bente |
| 4,416,072 | A | * | 11/1983 | Sarkissian ..... 36/100 |
| 4,445,288 | A | | 5/1984 | Frör |
| 4,445,289 | A | | 5/1984 | Benéteau |
| 4,450,633 | A | | 5/1984 | Connelly |
| 4,492,047 | A | | 1/1985 | Arff |
| 4,546,559 | A | | 10/1985 | Dassler |
| 4,559,724 | A | | 12/1985 | Norton |
| 4,564,966 | A | | 1/1986 | Chen |
| 4,631,842 | A | | 12/1986 | Koskela |
| 4,633,600 | A | | 1/1987 | Dassler et al. |
| 4,644,672 | A | | 2/1987 | Dassler et al. |
| 4,646,350 | A | | 2/1987 | Batra |
| 4,648,187 | A | | 3/1987 | Dassler et al. |
| 4,667,425 | A | | 5/1987 | Effler et al. |
| 4,698,923 | A | | 10/1987 | Arff |
| 4,712,318 | A | | 12/1987 | Greiner et al. |
| 4,805,320 | A | | 2/1989 | Goldenberg et al. |
| 4,839,948 | A | | 6/1989 | Boros |
| 4,914,838 | A | | 4/1990 | Ihlenburg |
| 4,967,454 | A | | 11/1990 | Elieff |
| 5,025,576 | A | | 6/1991 | Biasiotto et al. |
| 5,058,292 | A | | 10/1991 | Tanel |
| 5,133,138 | A | | 7/1992 | Durcho |
| 5,243,775 | A | | 9/1993 | Swain |
| 5,259,129 | A | | 11/1993 | Deacon et al. |
| 5,293,701 | A | | 3/1994 | Sullivan |
| 5,299,369 | A | | 4/1994 | Goldman |
| 5,337,494 | A | | 8/1994 | Ricker |
| 5,339,544 | A | | 8/1994 | Caberlotto |
| 5,361,518 | A | | 11/1994 | Sussmann et al. |
| 5,432,986 | A | | 7/1995 | Sexton |
| 5,473,827 | A | | 12/1995 | Barre et al. |
| D366,135 | S | | 1/1996 | Henderson, Jr. et al. |
| 5,485,733 | A | | 1/1996 | Hoffman |
| 5,513,451 | A | | 5/1996 | Kataoka et al. |
| 5,604,960 | A | | 2/1997 | Good |
| 5,628,129 | A | | 5/1997 | Kilgore et al. |
| 5,638,615 | A | | 6/1997 | Korsen |
| 5,709,954 | A | | 1/1998 | Lyden et al. |
| 5,713,140 | A | | 2/1998 | Baggenstoss |
| 5,732,482 | A | | 3/1998 | Remington et al. |
| 5,775,010 | A | | 7/1998 | Kaneko |
| 5,782,017 | A | | 7/1998 | Ortscheid |
| 5,786,057 | A | | 7/1998 | Lyden et al. |
| 5,848,482 | A | | 12/1998 | Bathum |
| 5,873,184 | A | | 2/1999 | Ihlenburg |
| 5,960,568 | A | | 10/1999 | Bell et al. |
| 6,032,386 | A | | 3/2000 | Evans |
| 6,050,006 | A | | 4/2000 | Swindle |
| 6,090,087 | A | | 7/2000 | Tsukada et al. |
| 6,108,944 | A | | 8/2000 | Savoie |
| 6,260,292 | B1 | | 7/2001 | Swedick et al. |
| 6,301,806 | B1 | | 10/2001 | Heller |
| 6,389,711 | B1 | | 5/2002 | Polegato |
| 6,421,937 | B2 | | 7/2002 | Heller |
| 6,513,266 | B1 | | 2/2003 | Ijiri |
| 2002/0174571 | A1 | | 11/2002 | Briant et al. |

FOREIGN PATENT DOCUMENTS

| | | |
|---|---|---|
| DE | 24 54 241 | 5/1976 |
| DE | 25 01 561 | 7/1976 |
| DE | 26 23 931 | 12/1977 |
| DE | 26 29 712 | 1/1978 |
| DE | 26 45 963 | 4/1978 |
| DE | 27 19 909 | 11/1978 |
| DE | 27 33 846 | 2/1979 |
| DE | 27 39 212 | 3/1979 |
| DE | 27 55 844 | 6/1979 |
| DE | 28 01 983 | 7/1979 |
| DE | 28 10 363 | 9/1979 |
| DE | 28 20 381 | 11/1979 |
| DE | 28 27 172 | 1/1980 |
| DE | 30 03 631 | 8/1981 |
| DE | 30 15 116 | 10/1981 |
| DE | 30 48 973 | 7/1982 |
| DE | 31 34 817 | 3/1983 |
| DE | 31 48 059 | 6/1983 |
| DE | 32 42 606 | 8/1983 |
| DE | 32 08 857 | 9/1983 |
| DE | 32 35 475 | 3/1984 |
| DE | 33 00 330 | 7/1984 |
| DE | 33 42 397 | 6/1985 |
| DE | 34 38 060 | 6/1985 |
| DE | 31 48 038 | 10/1985 |
| DE | 34 31 893 | 10/1985 |
| DE | 34 23 363 | 1/1986 |
| DE | 34 33 337 | 3/1986 |
| DE | 35 41 897 | 1/1987 |
| DE | 36 27 014 | 2/1988 |
| DE | 37 03 932 | 8/1988 |
| DE | 37 06 071 | 9/1988 |
| DE | 37 06 422 | 9/1988 |
| DE | 38 11 513 | 10/1989 |
| DE | 39 24 360 | 1/1991 |
| DE | 40 10 685 | 5/1991 |
| DE | 40 14 064 | 11/1991 |
| DE | 41 23 302 | 1/1993 |
| DE | 41 38 941 | 6/1993 |
| EP | 0 061 715 | 12/1984 |
| EP | 0 103 507 | 11/1985 |
| EP | 0 171 228 | 2/1986 |
| EP | 0 171 621 | 2/1986 |
| EP | 0 183 860 | 6/1986 |
| EP | 0 210 362 | 2/1987 |
| EP | 0 248 664 | 12/1987 |
| EP | 0 261 557 | 3/1988 |
| EP | 0 280 108 | 8/1988 |
| EP | 0 163 823 | 9/1988 |
| EP | 0 184 607 | 11/1988 |
| EP | 0 193 024 | 5/1989 |
| EP | 0 346 624 | 12/1989 |
| EP | 0 360 202 | 3/1990 |
| EP | 0 451 379 | 10/1991 |
| EP | 0 501 853 | 9/1992 |
| EP | 0 282 257 | 12/1993 |
| EP | 0 783 845 | 7/1997 |
| EP | 0 815 759 | 1/1998 |
| EP | 0 744 907 | 6/1999 |
| EP | 1 068 813 | 1/2001 |
| FR | 2 362 685 | 4/1978 |
| FR | 2 365 306 | 5/1978 |
| FR | 2 398 471 | 3/1979 |
| FR | 2 404 407 | 6/1979 |
| FR | 2 467 558 | 5/1981 |

| | | |
|---|---|---|
| FR | 2 475 373 | 8/1981 |
| FR | 2 486 372 | 1/1982 |
| FR | 2 532 825 | 3/1984 |
| FR | 2 539 595 | 7/1984 |
| FR | 2 588 729 | 4/1987 |
| FR | 2 644 989 | 10/1990 |
| FR | 2 697 413 | 5/1994 |
| GB | 2 020 161 | 11/1979 |
| GB | 2 028 102 | 3/1980 |
| GB | 2 098 457 | 11/1982 |
| GB | 2 115 683 | 9/1983 |
| GB | 2 160 146 | 12/1985 |
| GB | 2 252 488 | 8/1992 |
| GB | 2 257 616 | 1/1993 |
| GB | 2 313 999 | 12/1997 |
| JP | 091 08 009 | 4/1997 |
| WO | WO 81/01499 | 6/1981 |
| WO | WO 86/06592 | 11/1986 |
| WO | WO 90/09117 | 8/1990 |
| WO | WO 91/04685 | 4/1991 |
| WO | WO 91/15131 | 10/1991 |
| WO | WO 92/18027 | 10/1992 |
| WO | WO 94/09659 | 5/1994 |
| WO | WO 95/10957 | 4/1995 |
| WO | WO 95/22915 | 8/1995 |
| WO | WO 97/15206 | 5/1997 |
| WO | WO 99/53790 | 10/1999 |

* cited by examiner

MAGNETICALLY OPERABLE STUDS FOR FOOTWEAR

CROSS-REFERENCE TO RELATED APPLICATION

This application is a continuation of U.S. application Ser. No. 10/654,277, entitled Magnetically Operable Studs For Footwear, filed on Sep. 3, 2003, which incorporates by reference, and claims priority to and the benefit of, German patent application serial number 10241153.0, filed on Sep. 5, 2002.

TECHNICAL FIELD

The present invention generally relates to a releasable stud for a shoe sole and to a shoe having at least one such stud. In particular, the invention relates to a magnetically releasable stud for a soccer shoe and to a soccer shoe having at least one such stud.

BACKGROUND

For many kinds of shoes, studs are used to improve traction. For example, with a soccer shoe or a golf shoe, studs are used to penetrate the grass surface on which the shoe is used, thereby preventing the shoe from sliding.

Shoes with studs that can be releasably fastened thereto are desirable for several reasons. First, differently shaped studs may be selected and used under different conditions. For example, one type of stud may be used where the ground is dry and another type of stud may be used where the ground is wet. Second, if a stud is worn out, it may be individually replaced, as opposed to replacing the entire sole or shoe.

In some cases, cylindrically-shaped threaded studs are used. For example, cylindrically-shaped threaded studs are sometimes used with soccer shoes. A threaded extension on an upper portion of the stud is screwed into a corresponding threaded opening of the sole.

Higher quality studs, however, are not symmetric like the cylindrically-shaped threaded studs, but rather have an oblong shape. The oblong shape of the stud, together with the orientation of the stud, is optimized for the respective position of the stud on the sole. Such a stud cannot be fastened to the sole by threading.

Furthermore, threading a stud to the sole is very time-consuming. This is problematic where, for example, all the studs of a shoe need to be replaced quickly during a soccer game or a golf tournament, because of changing ground conditions.

Different approaches have been suggested to overcome these difficulties. The special properties of studs, however, limit the number of available solutions. For example, the special properties of studs prevent one from using solutions used for releasably fastening other sole elements as solutions for releasably fastening studs. For example, due to the extremely small volume of a stud, or its receptacle, it is difficult to transfer solutions for the releasable attachment of heels, known from U.S. Pat. Nos. 3,977,095 and 5,133,138, the disclosures of which are hereby incorporated herein by reference in their entireties, to the releasable fastening of studs.

A successful approach for quickly fastening studs to a sole is disclosed in Applicant's. U.S. Pat. No. 6,421,937, the disclosure of which is hereby incorporated herein by reference in its entirety. The stud in that document includes a moveable hook that can be shifted by slightly rotating a bolt arranged at the backside of the stud. In rotating the bolt, the hook engages a corresponding recess of the sole and anchors the stud to the sole with a positive fit.

U.S. Pat. No. 6,260,292, the disclosure of which is hereby incorporated herein by reference in its entirety, discloses another example of a releasable stud that does not require threads to fasten/release the stud to/from a sole. A spring mechanism, which includes a ball, locks the stud inside a receptacle of the sole. To release the stud, a special tool is inserted into an opening of the stud and used to separate the stud from the spring mechanism.

In theory, the above discussed stud constructions can substantially reduce the time needed to replace a complete set of the studs, in comparison to studs that require threads. In practice, however, experiences are quite different. For example, dirt adhering to the stud can render the operation of the above described mechanisms difficult. As such, a fast replacement of a set of studs is not always possible. Furthermore, releasable studs of known construction often unintentionally loosen, or even detach, from the sole.

It is, therefore, an object of the present invention to provide a stud that can be reliably and quickly released, even under the most adverse conditions, from a shoe sole, but that does not, at the same time, unintentionally loosen from the shoe sole. A further object of the present invention is to provide a shoe, in particular a soccer shoe, having at least one such stud.

SUMMARY OF THE INVENTION

The present invention relates to a releasable stud for a shoe sole. The releasable stud has a stud body and a first fastening mechanism coupled to the stud body for interacting with a second fastening mechanism of the shoe sole. The first fastening mechanism is magnetically operable.

By magnetically operating the first fastening mechanism, one does not need to contact directly the stud in order to release or fasten the stud. One may, therefore, remove the releasable stud from the shoe sole even where the stud is completely covered by, for example, a hard layer of dirt. Specifically, the magnetic field used to operate the first fastening mechanism penetrates any accumulation of dirt, thereby allowing the stud to be easily released. In contrast, it is often impossible, in such a situation, to mechanically engage and remove the stud with a tool, as would be the case with the prior art constructions described above. As such, the instant invention overcomes the aforementioned difficulties of the prior art.

In one aspect, the invention relates to a releasable stud for a shoe sole. The stud includes a stud body and a first fastening mechanism coupled to the stud body. The first fastening mechanism interacts with a second fastening mechanism of the shoe sole. At least one of the first fastening mechanism and the second fastening mechanism is magnetically operable.

In another aspect, the invention relates to a sole for an article of footwear. The sole includes at least one stud and at least one receptacle disposed in the sole. The at least one stud includes a first fastening mechanism and the at least one receptacle includes a second fastening mechanism for interacting with the first fastening mechanism. At least one of the first fastening mechanism and the second fastening mechanism is magnetically operable to releasably fasten the stud to the receptacle.

In yet another aspect, the invention relates to an article of footwear that includes an upper and a sole. The sole includes at least one stud and at least one receptacle disposed in the sole. The at least one stud includes a first fastening mechanism and the at least one receptacle includes a second fastening mechanism for interacting with the first fastening mechanism. At least one of the first fastening mechanism and the second fastening mechanism is magnetically operable to releasably fasten the stud to the receptacle.

In various embodiments of the foregoing aspects of the invention, the first fastening mechanism and/or the second fastening mechanism includes at least one anchoring element for anchoring the stud to the receptacle of the shoe sole in an anchoring position and at least one magnetically operable locking element for locking the stud in the anchoring position. The anchoring element may be configured for insertion into the second fastening mechanism of the shoe sole and the anchoring element may be capable of being rotated to anchor the stud to the receptacle of the shoe sole in the anchoring position. The magnetically operable locking element may include a magnetically moveable pin.

In still other embodiments, a spring element is coupled to the magnetically moveable pin and is capable of moving the pin into a corresponding recess of at least one of the first fastening mechanism and the second fastening mechanism once the anchoring element has anchored the stud to the receptacle of the shoe sole in the anchoring position. In another embodiment, the magnetically moveable pin extends in a starting position from the stud body and is retractable into the stud body under the influence of a magnetic field to unlock the stud from the anchoring position.

In yet another embodiment, the anchoring element includes a T-shaped projection extending from the stud body. The anchoring element and the magnetically operable locking element may be sequentially arranged on a top surface of the stud body.

In further embodiments, at least one of the first fastening mechanism and the second fastening mechanism includes an opening and the opening includes side edges. The side edges may be engaged by the T-shaped projection when the anchoring element has anchored the stud to the receptacle in the anchoring position. In yet another embodiment, the sole further includes a recess for engaging a projection disposed on the second fastening mechanism.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the present invention are described with reference to the following drawings, in which.

DETAILED DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to studs and/or soles for soccer shoes, but rather it is to be understood that the present invention can also be used to produce studs, soles, and/or portions thereof for any article of footwear, including, but not limited to, golf shoes, sprint shoes, rugby shoes, baseball shoes, football shoes, hiking shoes, and climbing shoes. Further, only a left or right sole and/or shoe is depicted in any given figure; however, it is to be understood that the left and right soles/shoes are typically mirror images of each other and the description applies to both left and right soles/shoes. In certain activities that require different left and right shoe configurations or performance characteristics, the shoes need not be mirror images of each other.

Figure 1A:
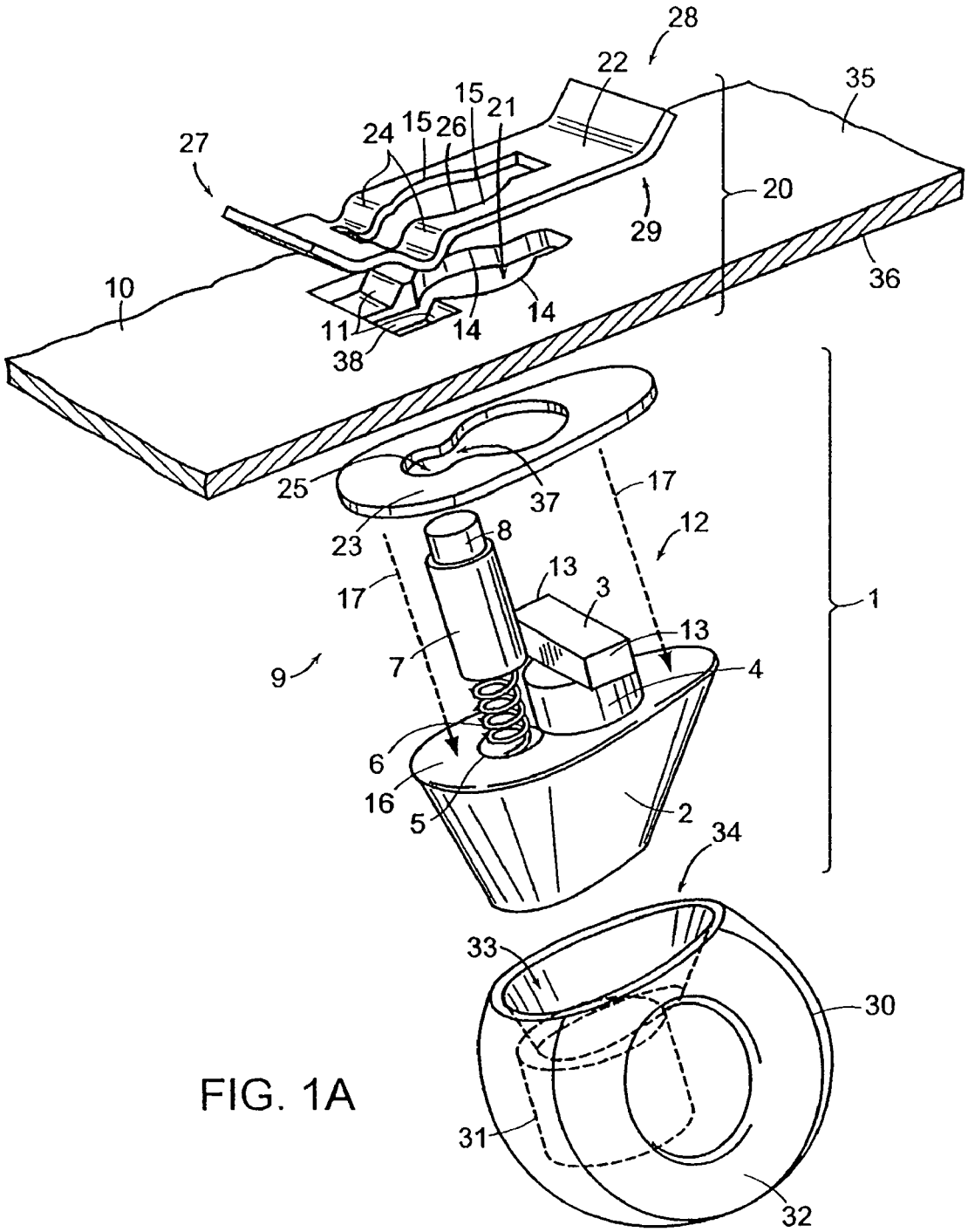
FIG. 1A is an exploded schematic perspective view of a stud assembly including a portion of a sole, a stud, and a magnet, in accordance with one embodiment of the invention.

FIG. 1A depicts one embodiment of a stud assembly in accordance with the invention. The stud assembly shown includes a portion of a sole 10, a stud 1, and a magnet 30. The portion of the sole 10 shown in FIG. 1A may be arranged at any part of the sole 10, as required by the respective field of use of the corresponding shoe. In addition, any number of studs 1 may be used and the studs 1 can have essentially any size or shape necessary to suit a particular application. In one embodiment, the stud 1 is releasably fastened to the sole 10.

The sole 10 includes at least one receptacle 20 for receiving the stud 1. The receptacle 20 may include a second fastening mechanism 28, which itself includes an opening 21 in the sole 10 and a reinforcing plate 22 that has an opening 26. In one embodiment, the receptacle 20 further includes bends 24 that, as described below, interact with recesses 11 in the sole 10.

Figure 1B:
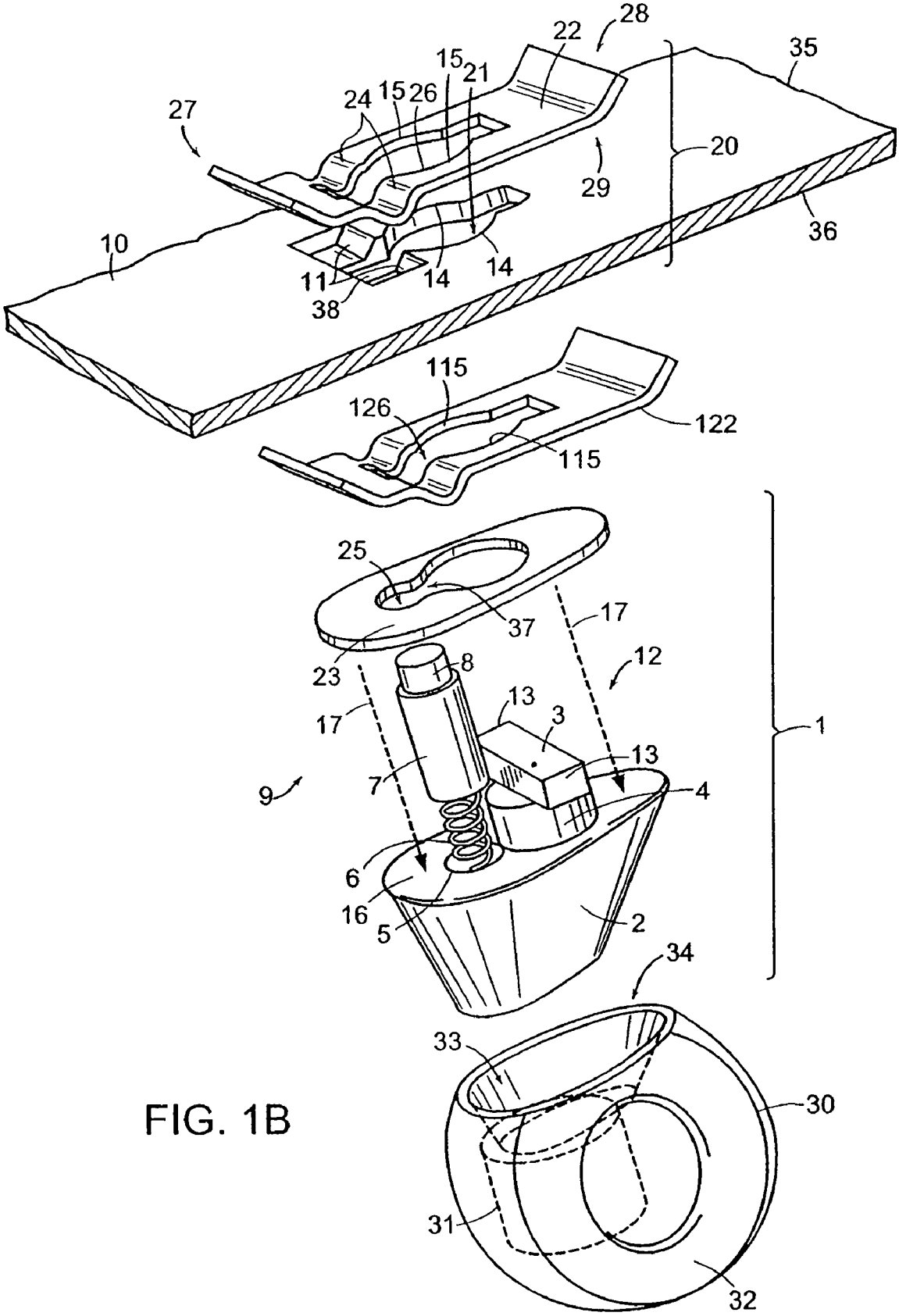
FIG. 1B is an exploded schematic perspective view of an alternative embodiment of the stud assembly of FIG. 1A, in accordance with the invention.

The opening 26 of the reinforcing plate 22 is disposed above the opening 21 in the sole 10. Moreover, the reinforcing plate 22 may be connected to an upper side 35 of the sole 10 by, for example, gluing, riveting, screwing, clipping, or other suitable techniques. Alternatively, the material of the sole 10 can be injection molded around the reinforcing plate 22 during the manufacture of the sole 10. In one embodiment, the reinforcing plate 22 includes, at a first end 27, the bends 24, which are curved elements that project from the reinforcing plate 22. Alternatively, the reinforcing plate 22 can include other three-dimensional protrusions at the first end 27. In yet another embodiment, the bends or other three-dimensional protrusions are, additionally or alternatively, located at an opposite, second end 29 of the receiving plate 22. In one embodiment, the bends 24 of the reinforcing plate 22 engage corresponding recesses 11 positioned in the sole 10 to provide additional support in mating the reinforcing plate 22 to the sole 10. In an alternative embodiment, an additional similarly configured reinforcing plate 122 is disposed on a lower side 36 of the sole 10 (FIG. 1B).

Figure 2:
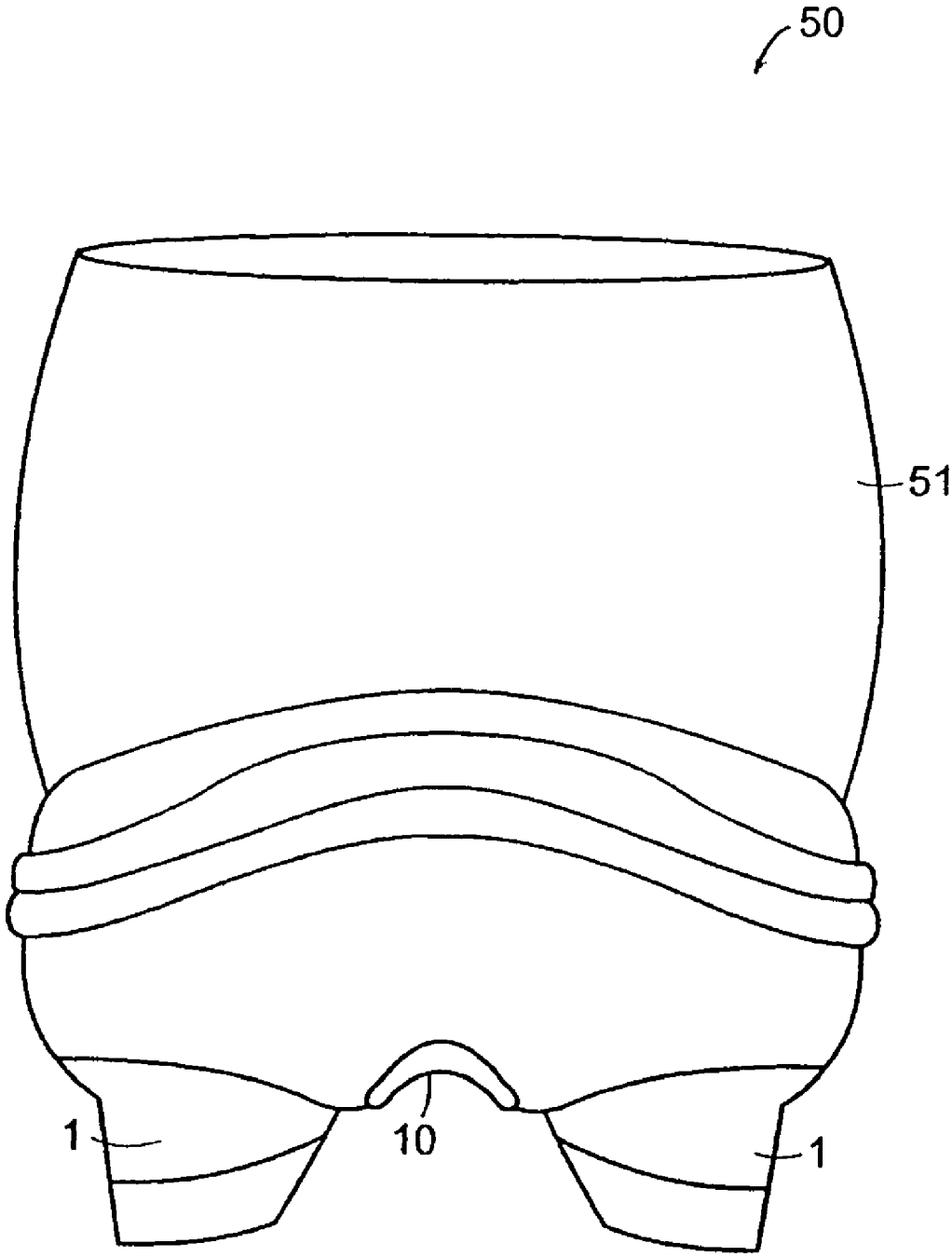
FIG. 2 is a schematic rear view of an article of footwear in accordance with one embodiment of the invention.

The stud 1 includes a stud body 2. The shape of the stud body 2 depends on the intended use of the article of footwear 50 (FIG. 2). For example, studs 1 for hard and dry surfaces may include stud bodies 2 that are pointed and have sharp edges. The studs 1 may be made, for example, from plastics or suitable metals, metal alloys or ceramics.

At its top surface 16, the stud 1 includes a first fastening mechanism 9 for interacting with the second fastening mechanism 28. At least one of the first fastening mechanism 9 and the second fastening mechanism 28 is magnetically operable to releasably fasten the stud 1 to the receptacle 20. As such, the magnetic operation of the invention, as described below, can either take place inside the article of footwear 50 (i.e., where the second fastening mechanism 28 is magnetically operable to releasably fasten the stud 1 to the receptacle 20), inside the stud 1 (i.e., where the first fastening mechanism 9 is magnetically operable to releasably fasten the stud 1 to the receptacle 20), or both inside the article of footwear 50 and inside the stud 1 (i.e., where both the second fastening mechanism 28 and the first fastening mechanism 9 are magnetically operable to releasably fasten the stud 1 to the receptacle 20).

The first fastening mechanism 9 may include at least one anchoring element 12, a recess 5 in the stud body 2, a spring element 6, and a magnetically operable locking element 7, such as, for example, a magnetically moveable locking element 7. In one embodiment, the anchoring element 12 includes a substantially T-shaped projection 3 extending from the stud body 2 and a cylindrical support 4. In the fastened state, the ends 13 of the T-shaped projection 3 engage the edges 14 of the opening 21 of the sole 10. In particular, the ends 13 of the T-shaped projection 3 engage the edges 15 of the opening 26 of the reinforcing plate 22 arranged above the edges 14 of the opening 21 of the sole 10. The stud 1 is thereby anchored to the sole 10 in an anchoring position.

In one embodiment, the dimensions of the cylindrical support 4 are substantially similar to the dimensions of the opening 21 between the edges 14. Accordingly, relative horizontal movements between the stud 1 and the sole 10 under horizontal forces are prevented. The T-shaped projection 3 also excludes, when the stud 1 is anchored to the sole 10 in the anchoring position, vertical movement between the stud 1 and the sole 10. As such, a stable anchoring of the stud 1 to the sole 10 is obtained.

In one embodiment, the magnetically operable locking mechanism 7 is a cylindrically-shaped pin. Alternatively, the locking element 7 may assume other shapes. The locking element 7 is sufficiently stable to provide the locking function described below. The locking element 7 is not so large, however, that it weakens the mechanical stability of the stud body 2. The arrangement of the locking element 7 and the anchoring element 12 on the top surface 16 of the stud body 2 is determined by the shape of the stud 1. In the case of a more oblong stud 1, as shown in FIG. 1A, the locking element 7 and the anchoring element 12 are sequentially arranged on the top surface 16 of the stud body 2.

In one embodiment, a spring element 6, such as, for example, a coil spring 6, is arranged below the locking element 7. Alternatively, a small elastomer element may be arranged below the locking element 7. The spring element 6 pushes the locking element 7 upwardly, so that an upper end 8 of the locking element 7 extends, in both a starting position of the stud 1 and in the anchoring position of the stud 1, as described below, beyond the top surface 16 of the stud body 2.

In one embodiment, the locking element 7 is made from a magnetic material so that it can be retracted in the direction of the recess 5 under the influence of an outer magnetic field. The locking element 7 may be made from either a paramagnetic or a diamagnetic material (i.e., the locking element 7 is either attracted or repelled by the outer magnetic field). In another embodiment, a small permanent magnet is used for the locking element 7. Depending on the orientation of the outer magnetic field, the small magnet is either attracted or repelled. Accordingly, the first fastening mechanism 9 may be magnetically operated without any direct contact. The present invention eliminates, therefore, the mechanical engagement required to fasten or release the prior art studs.

Referring still to FIG. 1A, the magnetically operable first fastening mechanism 9 is part of the stud 1 itself. In an alternative embodiment, however, the first fastening mechanism 9 is integrated into the second fastening mechanism 28 of the receptacle 20 of the sole 10. In such an embodiment, the T-shaped projection 3 and the locking element 7 extend downwardly from the sole 10 and engage corresponding recesses and undercuts of the stud body 2 (see, for example, FIG. 1C). In yet further embodiments, the anchoring element 12 is coupled to the stud body 2 and the locking element 7 is coupled to the sole 10, or vice versa.

On its top surface 16, the stud body 2 includes a gasket 23 that includes an opening 25. The gasket 23 serves several functions. First, it seals the outer edges of the anchoring element 12 and the locking element 7. Sand and/or dirt, for example, are thereby prevented from reaching the anchoring element 12 and the locking element 7 and from impairing their respective functions. Second, a smaller portion 37 of the opening 25 of the gasket 23 is shaped so as to prevent the spring element 6 from pushing the locking element 7 further than intended out of the recess 5 of the stud body 2. To this end, the smaller portion 37 of the opening 25 of the gasket 23 has dimensions that allow only the upper, narrower end 8 of the locking element 7 to pass therethrough.

As indicated by dashed arrows 17 in FIG. 1A, the gasket 23 is permanently fixed by, for example, gluing, over-injection or any other technique, to the top surface 16 of the stud body 2. The gasket 23 may be made from a variety of different materials, including, but not limited to, plastics, elastomers, and metals. In one embodiment, the gasket 23 reduces the friction between stud body 2 and the sole 10 to facilitate rotation during attachment of the stud 1, as explained below.

Figure 1C:
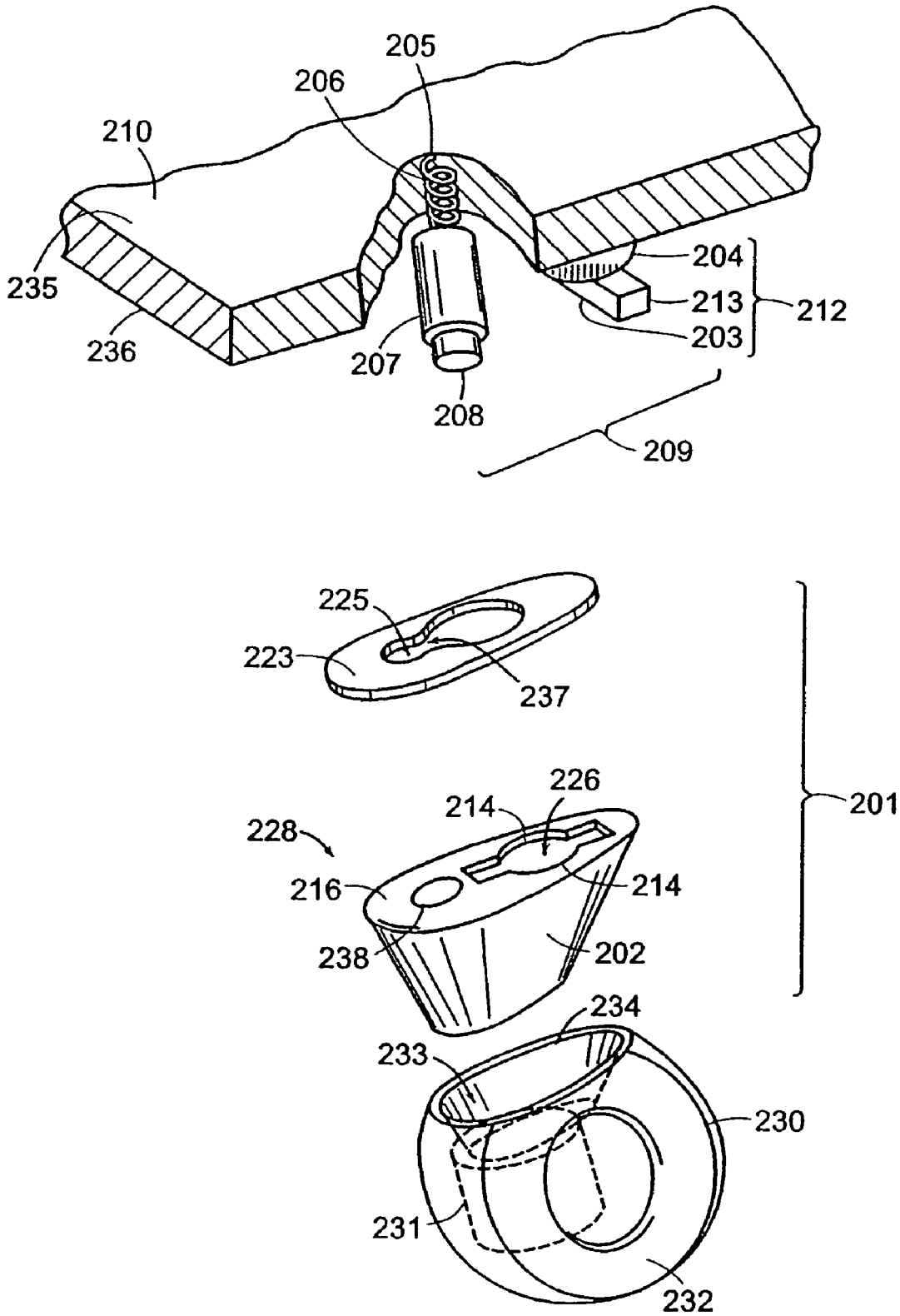
FIG. 1C is an exploded schematic perspective view of another alternative embodiment of the stud assembly of FIG. 1A, in accordance with the invention.

In the alternative embodiment depicted in FIG. 1C, the first fastening mechanism 209 and second fastening mechanism 228 are similar in structure and operation to those previously described, but the locations of the mechanisms 209, 228 are reversed. In this embodiment, the first fastening mechanism 209 is disposed on the sole 210 and the second fastening mechanism 228 is disposed in the stud 201. The first fastening mechanism 209 includes an anchoring element 212 that projects from the bottom surface 236 of the sole 210. The first fastening mechanism 209 also includes a magnetically operable locking element 207 and a spring element 206 disposed within a recess 205 in the sole 210. In the embodiment shown, the anchoring element 212 includes a substantially T-shaped projection 203 extending from the sole 210 and a cylindrical support 204.

The second fastening mechanism 228 includes an opening 226 defined by a top surface 216 of the stud body 202 for receiving the fastening element 212 and a second opening 238 defined by the top surface 216 of the stud body 202 for receiving the magnetically operable locking element 207. The opening 226 is sized and shaped to receive the anchoring element 212 and includes side edges 214 for engaging the ends 213 of the T-shaped projection 203 when anchored in the second fastening mechanism 228 (i.e., oriented in the anchoring position).

The magnetically operable locking element 207 shown in FIG. 1C is a cylindrically-shaped pin having an end 208 of reduced diameter; however, locking elements of other shapes may be used. The opening 238 is sized and shaped to receive the magnetically operable locking element 207. Once the stud 201 is engaged with the sole 210 and oriented in the anchoring position, the spring element 206 extends the magnetically operable locking element 207 into the opening 238 in the stud body 202 to lock the stud in place.

In one embodiment, the first fastening mechanism 209 includes a gasket 223 permanently affixed to the bottom surface 236 of the sole 210. As previously described with respect to FIG. 1A, the gasket 223 can seal the outer edges of the anchoring element 212 and the magnetically operable locking element 207 and can reduce friction between the stud body 202 and the sole 210. Additionally, the gasket 223 can be used to retain the magnetically operable locking element 207 in the recess 205. The gasket 223 can include an opening 225, a portion of which the anchoring element 212 passes through. The opening 225 can include a smaller portion 237 through which the reduced diameter end 208 of the magnetically operable locking element 207 passes. The smaller portion 237 is dimensioned to prevent the spring element 206 from pushing the magnetically operable locking element 207 further than intended out of the recess 205.

Various components of the stud 1 and the receptacle 20 can be manufactured by, for example, injection molding or extrusion. Extrusion processes may be used to provide a uniform shape, such as a single monolithic frame. Insert molding can then be used to provide the desired geometry of, for example, the recesses 11 and the openings 21, 25, 26, or the openings 21, 25, 26 could be created in the desired locations by a subsequent machining operation. Other manufacturing techniques include melting or bonding additional portions. For example, the reinforcing plate 22 may be adhered to the upper side 35 and/or to the lower side 36 of the sole 10 with a liquid epoxy or a hot melt adhesive, such as ethylene vinyl acetate (EVA). In addition to adhesive bonding, portions can be solvent bonded, which entails using a solvent to facilitate fusing of the portions to be added to, for example, the sole 10. The various components can be separately formed and subsequently attached or the components can be integrally formed by a single step called dual injection, where two or more materials of differing densities are injected simultaneously.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

An exemplary magnet 30, used to provide the aforementioned magnetic field, is also shown in FIG. IA. In one embodiment, the magnet 30 is made entirely from a permanent magnetic material. For example, the permanent magnet 30 may be manufactured with rare earth elements, thereby resulting in a high magnetic field strength. In another embodiment, the magnet 30 includes a magnetic core 31, as shown in FIG. 1A, which is surrounded by an outer shell 32. In still other embodiments, a solenoid energized by, for example, batteries is used in place of the magnet 30.

The outer shell 32 can have any arbitrary shape. For example, the outer shell 32 can be provided as a plastic key ring and the magnetic core 31 integrated therein, so that an athlete can always keep the magnet 30 with him. In one embodiment, as shown in FIG. 1A, the outer shell 32 is round, such that it is comfortable in the athlete's hand.

In one embodiment, the outer shell 32 includes, on an upper side 34, a recess 33 having a shape corresponding to that of the stud body 2. As such, one may engage the stud body 2 in the recess 33 of the magnet 30 and thereby bring the magnet 30 in a controlled manner close to the locking element 7, so that the locking element 7 is easily retracted, as described above.

In the embodiment where the magnetically operable first fastening mechanism 9 is integrated into the sole 10, the magnet 30 has a correspondingly modified shape for a deliberate action on the locking element 7. Moreover, for simultaneous replacement of several studs 1 of the sole 10, a magnetic tool can be provided to simultaneously act on and operate the first fastening mechanism 9 of several or all of the studs 1 of the sole 10 at the same time.

FIG. 2 depicts one embodiment of an article of footwear 50 in accordance with the invention. The article of footwear 50 can include any type of upper 51, conventional or otherwise, the sole 10, and one or more of the studs 1. As described above, in one embodiment, the studs 1 include the first fastening mechanism 9 and the sole 10 includes one or more receptacles 20, each having a second fastening mechanism 28 for receiving the one or more studs 1. The fastening and the release of the stud 1, to and from the sole 10, is described with respect to the remaining figures.

Figure 3A:
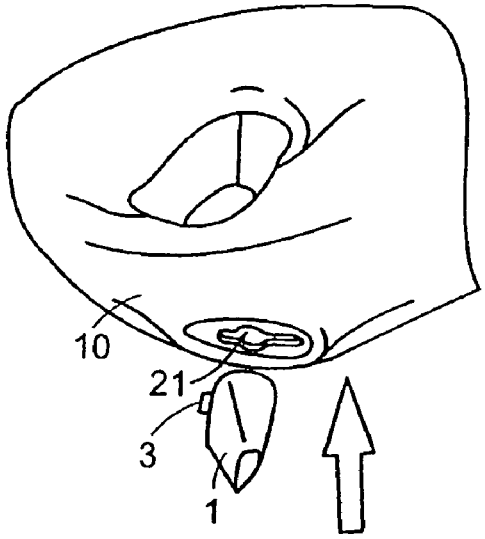
FIG. 3A is a schematic perspective view of a first step for fastening the stud of FIG. 1A to the sole of FIG. 1A, in accordance with one embodiment of the invention.
Figure 3B:
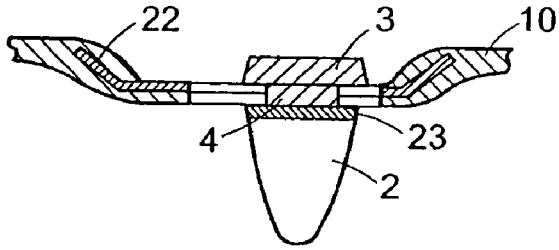
FIG. 3B is a schematic lateral view, in cross-section, of the first step depicted in FIG. 3A.
Figure 3C:
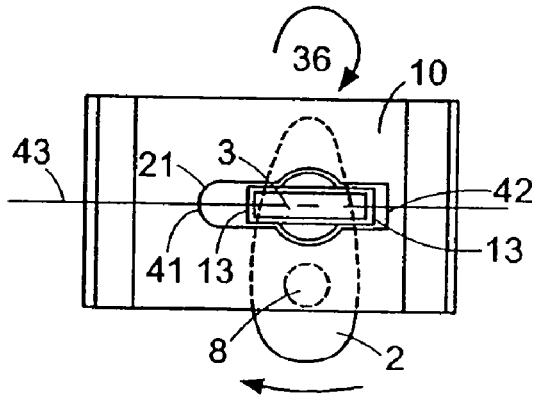
FIG. 3C is a schematic top view of the first step depicted in FIG. 3A.

FIGS. 3A-3C depict one embodiment of the first step for fastening the stud 1 to the sole 10, in accordance with the invention. The stud 1 is first rotated by approximately 90° (arrow 36 in FIG. 3C) in comparison to its final arrangement in the sole 10 (compare FIGS. 3C and 4C). Oriented as such, the stud 1 is inserted into the opening 21 of the sole 10 so that the ends 13 of the T-shaped projection 3 penetrate the oblong opening 21. Simultaneously, the locking element 7 is pushed by the sole 10 against the force of the spring element 6 into the recess 5 of the stud body 2. FIG. 3C shows, for example, in a dashed line, the upper end 8 of the locking element 7 contacting the lower side 36 of the sole 10. At the end of this first step for fastening the stud 1 to the sole 10, the T-shaped projection 3 is parallel to a longitudinal axis 43 of the opening 21.

Figure 4A:
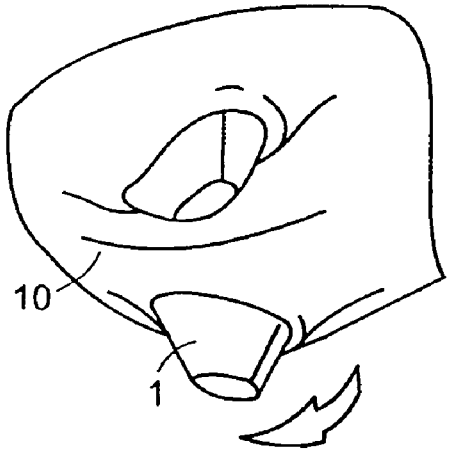
FIG. 4A is a schematic perspective view of a second step for fastening the stud of FIG. 1A to the sole of FIG. 1A, in accordance with one embodiment of the invention.
Figure 4B:
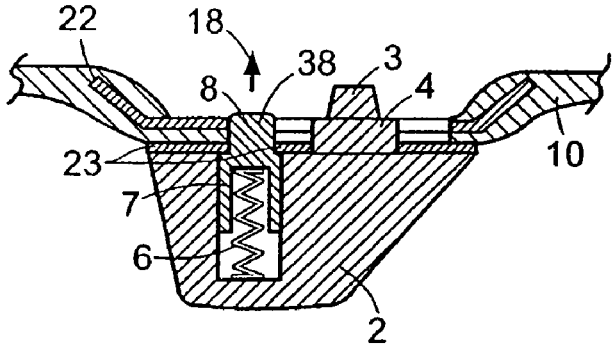
FIG. 4B is a schematic lateral view, in cross-section, of the second step depicted in FIG. 4A.
Figure 4C:
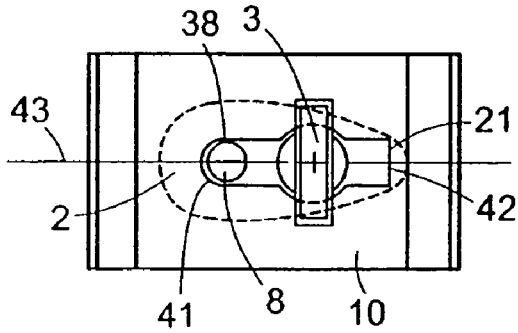
FIG. 4C is a schematic top view of the second step depicted in FIG. 4A.

FIGS. 4A-4C depict one embodiment of the second step for fastening the stud 1 to the sole 10, in accordance with the invention. By rotating the stud 1 approximately 90°, the stud 1 is correctly oriented for fastening to the sole 10. Specifically, the ends 13 of the T-shaped projection 3 engage the edges 15 of the reinforcing plate 22 and securely anchor the stud 1 in this position (i.e., the anchoring position) to the sole 10. As such, the T-shaped projection 3 of the anchoring element 12 assures a stable connection that can permanently resist mechanical loads arising between the stud 1 and the sole 10.

The locking element 7, which has until now been pushed back into the recess 5 of the stud body 2, is then upwardly pushed under the influence of the spring element 6 in the direction of arrow 18, as depicted in FIG. 4B, such that the upper end 8 of the locking element 7 engages a recess 38 at the first end 27 of the opening 21. As a result, the locking element 7 locks the stud 1 in the anchoring position and prevents the stud 1 from unintentionally rotating in the sole 10, loosening, and/or releasing from the anchoring position in the sole 10. In another embodiment, the recess 38 for the locking element 7 is not part of the opening 21, but is instead provided in a different manner in the sole 10.

As shown in FIGS. 3C and 4C, the opening 21 in the sole 10 (and the corresponding opening 26 in the reinforcing plate 22) may be asymmetric. In one embodiment, first ends 41 of the openings 21, 26 are rounded to receive the similarly rounded upper end 8 of the locking element 7. Second, opposite ends 42 of the openings 21, 26 are, in one embodiment, rectangularly-shaped to correspond to the T-shaped projection 3 and to differentiate from the rounded upper end 8 of the locking element 7. In such embodiments, the rounded upper end 8 of the locking element 7 is prevented from fitting through the openings 21, 26 at their second rectangularly-shaped ends 42. The rounded upper end 8 of the locking element 7 is only able to fit through the openings 21, 26 at their first rounded ends 41. As such, the stud 1 is prevented from locking to the sole 10 in an incorrect orientation. Consequently, the orientation of the stud 1 in the sole 10 is unambiguously determined.

Figure 5A:
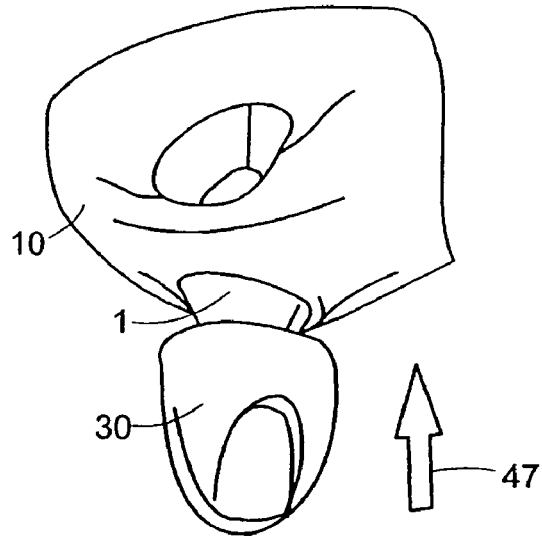
FIG. 5A is a schematic perspective view of a first step in accordance with one embodiment of the invention for releasing the stud of FIG. 1A from the sole of FIG. 1A.
Figure 5B:
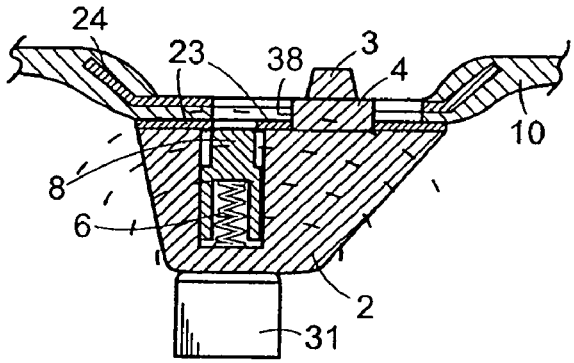
FIG. 5B is a schematic lateral view, in cross-section, of the first step depicted in FIG. 5A.

FIGS. 5A-5B depict one embodiment of the first step for releasing the stud 1 from the sole 10, in accordance with the invention. Referring first to FIG. 5A, the recess 33 of the magnet 30 is guided over the stud 1 in the direction of arrow 47. The locking element 7 is, thus, subjected to a magnetic field and the upper end 8 of the locking element 7 is retracted from the recess 38 of the sole 10, as illustrated in FIG. 5B. The stud 1 may then be freely rotated.

As described above, in an alternative embodiment, the first step for releasing the stud 1 from the sole 10 can be performed without directly contacting the stud 1. The magnetic field need only be brought sufficiently close to the stud 1; however, positioning the stud 1 in the recess 33 of the magnet 30 facilitates performance of the subsequent second step for releasing the stud 1 from the sole 10, as described below.

Figure 6:
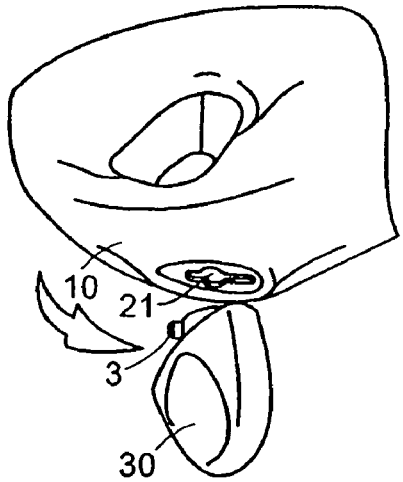
FIG. 6 is a schematic perspective view of a second step in accordance with one embodiment of the invention for releasing the stud of FIG. I A from the sole of FIG. 1A.

FIG. 6 depicts one embodiment of the second step for releasing, in accordance with the invention, the stud 1 from the sole 10. The stud 1 is rotated by approximately 90°. Since, in the first step for releasing the stud 1 from the sole 10, the locking element 7 was retracted by the influence of the magnetic field, such a rotation from the anchoring position requires only a very small force. In one embodiment, the rotation is done manually. In another embodiment, the magnet 30 is rotated, thereby also rotating the stud 1. Where, for example, the stud 1 adheres to the sole 10 due to the presence of dirt or mud, using the magnet 30 to rotate the stud 1 applies a greater torque to the stud 1 to overcome this resistance. By rotating the stud 1 by approximately 90°, the stud 1 is freed from the anchoring position. Subsequently, the stud 1 is removed from the opening 21.

Being able to magnetically operate the locking element 7, without needing to mechanically contact the locking element 7, is one advantage to the present invention. In particular, openings for inserting special tools, or engagement points on the outer surface of the stud 1, are not necessary. Even where the stud 1 is covered with a hard layer of dirt, a magnetic field will, without any problems, retract the locking element 7 in the interior of the stud 1, thereby allowing for an easy release.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A releasable stud for a shoe sole, the stud comprising:
a stud body adapted for improving traction; and
a first fastening mechanism coupled to the stud body and adapted to mechanically engage a second fastening mechanism of the shoe sole,
wherein the stud body is adapted to be released at least in part by application of a magnetic force.

2. The stud of claim 1, wherein the first fastening mechanism comprises at least one magnetically operable locking element adapted to lock the stud in an anchoring position.

3. The stud of claim 2, wherein the magnetically operable locking element comprises a magnetically moveable pin.

4. The stud of claim 3, wherein the magnetically moveable pin extends in a starting position from the stud body and is retractable into the stud body under the influence of the magnetic force to unlock the stud in the anchoring position.

5. The stud of claim 4, wherein a spring element is coupled to the magnetically moveable pin and the spring element is capable of moving the pin into a corresponding recess of the second fastening mechanism once the anchoring element has anchored the stud to the shoe sole in the anchoring position.

6. A releasable stud for a shoe sole, the stud comprising:
a stud body adapted for improving traction;
an anchoring element disposed on the stud body and adapted to releasably secure the stud body to the sole; and
a separate locking mechanism for locking the stud body to the sole to prevent inadvertent disengagement of the stud from the sole, wherein a magnetic force is required to unlock the locking mechanism.

7. The stud of claim 6, wherein the magnetically operable locking mechanism comprises a magnetically moveable pin.

8. The stud of claim 7, wherein the magnetically moveable pin extends in a starting position from the stud body and is retractable into the stud body under the influence of the magnetic force to unlock the stud in an anchoring position.

9. The stud of claim 8, wherein a spring element is coupled to the magnetically moveable pin and the spring element is capable of moving the pin into a corresponding recess of the shoe sole once the anchoring element has anchored the stud to the shoe sole in the anchoring position.

10. A sole for an article of footwear, the sole comprising:
a plurality of independently mountable stud bodies, each comprising a first fastening mechanism adapted to mechanically engage a second fastening mechanism on the shoe sole; and
a plurality of independent locking mechanisms, each disposed at least partially within a corresponding stud body for locking the stud body to the sole to prevent inadvertent disengagement of the stud body from the sole,
wherein a magnetic force is required to unlock each locking mechanism.

11. The stud bodies of claim 10, wherein each magnetically operable locking mechanism comprises a magnetically moveable pin.

12. The stud bodies of claim 11, wherein each magnetically moveable pin extends in a starting position from the corresponding stud body and is retractable into the corresponding stud body under the influence of the magnetic force to unlock the stud in an anchoring position.

13. The stud bodies of claim 12, wherein a spring element is coupled to each magnetically moveable pin and the spring element is capable of moving the pin into a corresponding recess of the second fastening mechanism once the first fastening mechanism has mechanically engaged the second fastening mechanism to anchor the stud to the shoe sole in the anchoring position.

* * * * *